US005399116A

United States Patent [19]

Ellis et al.

[11] Patent Number: 5,399,116

[45] Date of Patent: Mar. 21, 1995

[54] GRINDING WHEEL ASSEMBLY FOR GRINDING AND SIZING AN ELASTOMERIC BELT

[75] Inventors: Randy L. Ellis, Roan Mountain; Ben H. Patton, Milligan Colg.; Jerry R. Walls, Erwin, all of Tenn.

[73] Assignee: Kennametal Inc., Latrobe, Pa.

[21] Appl. No.: 112,335

[22] Filed: Aug. 27, 1993

[51] Int. Cl.[6] ..... B24D 5/00

[52] U.S. Cl. ..... 451/540; 451/544; 451/548; 451/547; 451/545

[58] Field of Search ..... 51/207, 209 P, 209 R, 51/103, 181 R; 451/544, 548, 547, 545

[56] References Cited

U.S. PATENT DOCUMENTS

| | | | |
|---|---|---|---|
| 2,077,100 | 4/1937 | Edgar . | |
| 2,451,295 | 11/1948 | Metzger | 51/181 |
| 2,616,230 | 11/1952 | Hough | 51/207 |
| 2,624,159 | 1/1953 | Balsiger . | |
| 3,898,772 | 8/1975 | Sawluk | 51/206 P |
| 4,114,322 | 9/1978 | Greenspan . | |
| 4,940,039 | 7/1990 | Buettner . | |
| 5,251,408 | 8/1993 | Boaz | 51/206 P |

OTHER PUBLICATIONS

Norton Company. "Grinding—Wheels-Machines-Methods." 1922, pp. 59-61 & 69-73.

*Primary Examiner*—Bruce M. Kisliuk
*Assistant Examiner*—Derris H. Banks
*Attorney, Agent, or Firm*—James G. Porcelli; Stanislav Antolin

[57] ABSTRACT

A grinding wheel assembly for grinding and sizing workpieces such as an elastomeric power transmission belt is provided that comprises a wheel member including an abrasive, annular outer surface, a pair of annular flange members detachably connectable to opposing sides of the wheel member for providing opposing annular flanges that circumscribe and radially extend beyond opposing sides of the outer surface of the wheel member, wherein each of the flanges includes an inner abrasive surface for sizing a workpiece which is substantially coarser than the abrasive surface on the outer surface of the wheel member. Additionally, an undercut portion is provided beneath the distal end of each of the inner side surfaces of the flange members for providing a space for collecting grindings produced by the sizing operation, as well as for creating a flow of turbulent air which effectively expels the grindings from the assembly, thereby preventing them from accumulating and compacting between the inner sides of the flanges of the grinding wheel assembly and the belt or other workpiece.

16 Claims, 3 Drawing Sheets

GRINDING WHEEL ASSEMBLY FOR GRINDING AND SIZING AN ELASTOMERIC BELT

BACKGROUND OF THE INVENTION

This invention generally relates to grinding wheels, and is specifically concerned with a grinding wheel assembly for grinding and laterally sizing elastomeric power transmission belts.

Grinding wheels for grinding and sizing elastomeric belts are known in the prior art. Such wheels generally comprise a wheel member having an outer surface which includes a plurality of v-shaped valleys and peaks that are covered with an abrasive coating. A pair of opposing annular flanges is integrally formed on the side surfaces of the wheel member that radially extend beyond the abrasive outer surface of the wheel member. The same type of abrasive coating which overlies the outer surface of the wheel member is applied to the inner sides of the flanges. Additionally, the outermost portion of each of the flanges includes a tapered lead-in. In operation, the tapered lead-ins of the opposing flanges receive an elastomeric belt to be ground and sized. The abrasive coating on the inner sides of the flanges trims the belt to a specific width, while the outer surface of the wheel grinds the inner surface of the belt into a peak-and-valley pattern complementary to that on the outer surface of the wheel member.

While such prior art grinding wheel assemblies are generally adequate for their intended purpose, the applicants have noted two areas where the operation of such grinding wheels could be greatly improved. First, the applicants have observed that the swarf or grindings generated by the cutting operation tend to accumulate and compact between the sides of the elastomeric belt and the inner surfaces of the flanges of the wheel assembly. The accumulation and compaction of such grindings interferes with the cutting operation on the sides of the belt, and can result in an improper lateral sizing of the belt. Worse yet, the large amount of friction created by such an accumulation and compaction of grindings can not only slow production, but actually burn the sides of the elastomeric belt. While the space between the sides of the belt and the inner surfaces of the flanges can be regularly cleaned to prevent such a harmful build up of grindings, such cleanings lower productivity by increasing downtime. Second, because the abrasive coating on the inner side surfaces of the flanges must work relatively harder than the abrasive coating on the outer portion of the wheel due to the relatively heavier grinding load applied thereon, these coatings tend to wear out well before the abrasive coating on the wheel member. Such an uneven wear pattern necessitates more frequent refurbishings or replacements of the wheel than would be the case if wear on all of the abrasive coatings were uniform.

Clearly, there is a need for an improved grinding wheel assembly that is capable of grinding and-laterally sizing an elastomeric belt without accumulating and compacting fine particles of belt grindings between the belt and the side flanges. Ideally, such a grinding wheel assembly would be capable of expelling such swarf or grindings from the wheel as soon as they were produced in order to obviate the need for frequent cleaning operations. It would further be desirable if the abrasive inner surfaces of the flanges were capable of performing their lateral sizing operation with a minimum amount of friction in order to expedite production and prevent burn damage to the belt. Finally, it would be desirable if the abrasive coatings on the wheel flanges did not wear out any faster than the abrasive coating on the outer portion of the wheel in order to maximize the time between refurbishings and replacements.

SUMMARY OF THE INVENTION

The invention is a grinding wheel assembly that eliminates or at least ameliorates all of the aforementioned shortcomings associated with prior art grinding wheel assemblies. The invention comprises a wheel member having an abrasive, annular outer surface, and a pair of opposing annular flanges disposed around and radially extending beyond the abrasive outer surface of the wheel member, wherein each of the flanges includes an inner abrasive surface for sizing a workpiece, such as an elastomeric belt, that is substantially coarser than the abrasive outer surface of the wheel member. The provision of a coarser abrasive surface on the inner surface of each flange advantageously reduces the friction and therefore the heat associated with the lateral sizing operation of a belt, and protracts the life span of the abrasive coating on the side flanges.

Preferably, each of the inner side surfaces of the flanges includes an undercut portion that extends from a distal portion of the inner abrasive surface to a point below the abrasive, annular outer surface of the wheel member. Such an undercut portion provides an area for the grindings created by the grinding and sizing operation to collect. It is further believed that such an undercut portion generates turbulent air currents at the lower inner sides of each of the flanges which advantageously serves to expel the grindings as they collect within the undercut portions. Thus the undercut portions prevent the grindings from accumulating and compacting between the inner side surfaces of the flanges and the side surfaces of the belt during the sizing and grinding operation.

The flanges are preferably formed on the outer peripheries of flange members which are detachably connectable over the sides of the wheel member. The detachability of each of the flange members advantageously allows them to be removed and separately coated and recoated with a relatively coarser diamond grit (i.e., between 20 and 30 mesh) than the diamond grit used on the outer surface of the grinding wheel (which is preferably between about 140 to 170 mesh). Additionally, the fact that the undercut portions on the inner surfaces on each of the flanges of the flange members extends down substantially below the outer surface of the wheel member still allows ample room for the grindings to collect and to be expelled even as the outer diameter of the grinding wheel becomes less and less over time as the wheel member wears and is reground and refurbished with an abrasive coating.

The grinding wheel assembly of the invention not only solves the problems associated with prior art grinding wheels for sizing and grinding elastomeric belts, but also is easily retrofitted onto such prior art grinding wheels by merely grinding off the old, integrally-formed flanges in order to form an annular recess where the flange members of the invention may be received and attached.

BRIEF DESCRIPTION OF THE SEVERAL FIGURES

DETAILED DESCRIPTION OF THE PREFERRED EMBODIMENT

Figure 1B:
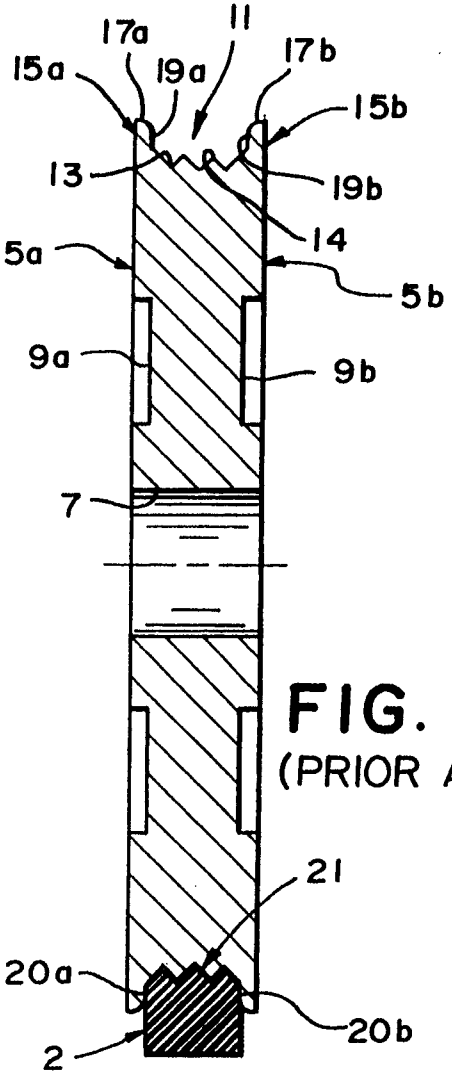
FIG. 1B (PRIOR ART)
FIG. 1B is a cross-sectional view of the grinding wheel assembly and belt illustrated in FIG. 1A along the line 1B—1B.
Figure 1A:
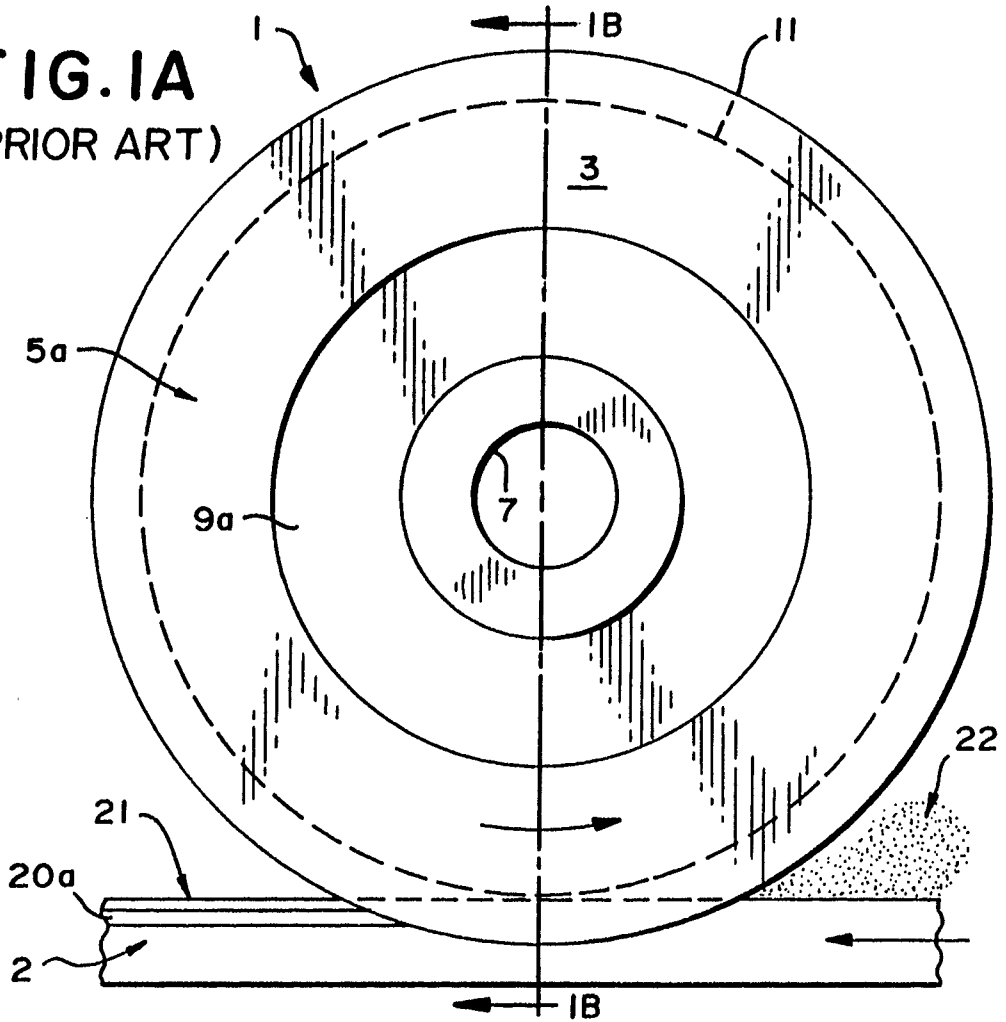
FIG. 1A (PRIOR ART)
FIG. 1A is a side view of a prior art grinding wheel assembly, illustrating how the wheel member grinds and laterally sizes the inner surface of an elastomeric belt.

FIGS. 1A and 1B illustrate the type of prior art grinding wheel assembly 1 that the instant invention improves upon. Such an assembly 1 is used to grind the inner surface and to cut the sides of an elastomeric power transmission belt 2 to precise dimensions. The prior art grinding wheel assembly 1 includes a wheel member 3 having opposing, circular sides 5*a*, 5*b*. A center bore 7 is concentrically disposed with respect to the axis of rotation of the wheel member 3, and provides an opening for a threaded power shaft (not shown) to extend through. Inner annular recesses 9*a,b* are provided on each of the opposing, circular sides 5*a,b* of the wheel member 3. The purposes of these recesses 9*a,b* is to reduce the weight and mass of the wheel member 3.

The wheel member 3 includes an abrasive outer surface 11 around its outer periphery formed from which is coated with fine diamond particles which are partially encased in a matrix of nickel. The contour of the abrasive outer surface 11 follows a sawtooth pattern having v-shaped grooves 13 flanked by v-shaped peaks 14. Flanking the sides of the abrasive outer surface 11 are a pair of annular flanges 15*a,b* which radially extend beyond the outer surface 11 as shown. Each of the annular flanges 15*a,b* is integrally formed with the sides 5*a,b* of the wheel member 3. The inner top portions of each of the annular flanges 15*a,b* includes tapered lead-ins 17*a,b*. Immediately below the lead-ins 17*a,b* are inner abrasive surfaces 19*a,b* whose function is to trim the sides of the belt 2 to accurate dimensions. In the prior art, both the abrasive outer surface 11 of the wheel member 3 and the inner abrasive surfaces 19*a,b* of the integrally formed, annular flanges 15*a,b* were coated with abrasive diamond particles of the same relatively small size. In particular, the entire outer surface of the wheel assembly starting from the tapered lead-ins 17*a,b* to the inner abrasive surfaces 19*a,b* and all throughout the v-shaped grooves and peaks of the abrasive outer surface 11 were coated with 140–170 mesh diamond particles partially encased in a matrix coating of metallic nickel which was deposited by way of a conventional electro deposition technique.

In operation, the previously mentioned drive shaft rotates such prior art grinding wheel assemblies 1 at a speed of approximately 3100 rpms. At the same time, the inner surface of an elastomeric belt 2 to be ground and sized is fed in between the integrally formed annular flanges 15*a,b* of the wheel member 3. The tapered lead-ins 17*a,b* facilitate the feeding-in step of the operation, and the inner abrasive surfaces 19*a,b* grind down the sides of the belt 2 to create precision-cut side portions 20*a,b*. At the same time, the abrasive outer surface 11 of the wheel member 3 grinds the sawtooth pattern of v-shaped grooves and peaks 13 and 14 into the inner surface 21 of the belt 2. In the preferred embodiment, both the wheel member 3 and the integrally formed annular flanges 15*a,b* are made of 4140 steel.

The combined effect of these sizings and grinding operations creates a swarf 22 in the form of fine, particulate grindings. Unfortunately, some of the grindings 22 accumulate between the flanges 15*a,b* and the side portions 20*a,b* of the belt 2. The accumulation of a few such grinding encourages the accumulation of others. Eventually, a compacted layer of grindings 22 form over the inner abrasive surfaces 19*a,b* of the flanges 15*a,b* which not only increases the friction between the wheel member 3 and the belt 2 to an unacceptable level, but further prevents the abrasive coating on the inner surfaces 19*a,b* from performing its intended function. To remedy such a situation, it is necessary to halt production and clean out the compacted, unwanted layer of grindings 22 from the inner surfaces 19*a,b* of the flanges 15*a,b*.

Figure 2B:
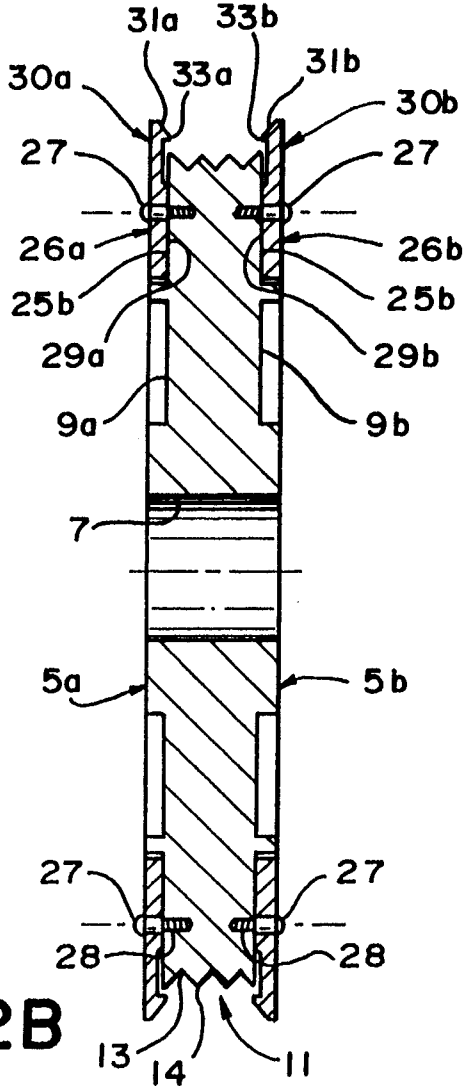
FIG. 2B is a front, cross-sectional view of the wheel assembly illustrated in FIG. 2A along the line 2B—2B.
Figure 2A:
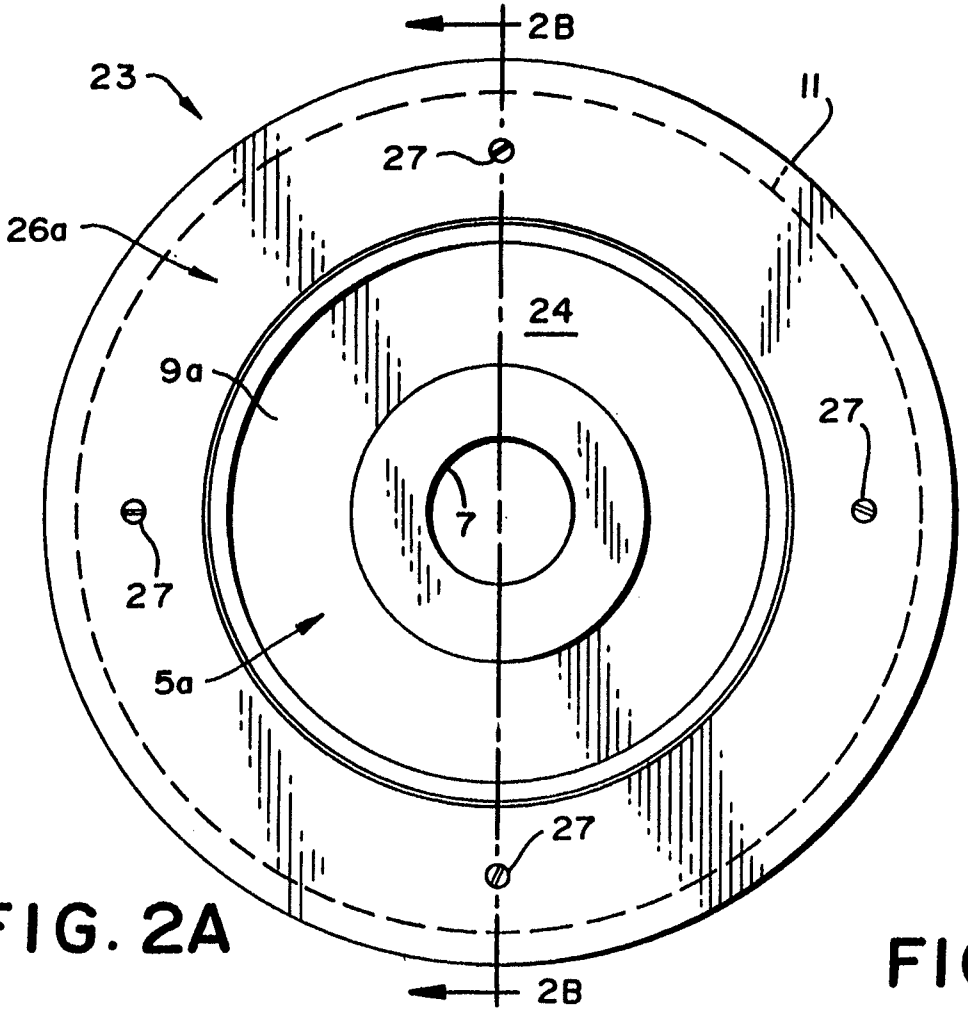
FIG. 2A is a side view of the grinding assembly of the invention.

With reference now to FIGS. 2A and 2B, the grinding wheel of the invention 23 includes a wheel member 24 having opposing, outer annular recesses 25*a,b* around the periphery of each of its opposing, circular sides 5*a,b*. In lieu of the previously described integrally-formed annular flanges 15*a,b*, the assembly 23 comprises a pair of annular flange members 26*a,b* which are receivable within the annular recesses 25*a,b*. These flange members 26*a,b* are detachably secured in their respective annular recesses 25*a,b* by means of mounting screws 27 which threadedly engage bores 28. While the inner side surfaces 29*a,b* of the annular flange member 26 are illustrated as being flush against the surface of the outer annular recesses 25*a,b* into which they are received, annular shimming members (not shown) may be disposed between the recesses 25*a,b* and side surfaces 29*a,b* to adjust the distance between the inner surfaces of the flanges on the flange members 26*a,b* if desired.

The outer edges of the annular flange members 26*a,b* terminate in annular flanges 30*a,b*. The upper, inner portions of the annular flanges 30*a,b* include tapered lead-ins 31*a,b* whose overall purpose is the same as that of previously discussed lead-ins 17*a,b*. Directly beneath these tapered lead-ins are a pair of inner flange surfaces 33*a,b* that function to cut the sides of an elastomeric belt or other elongated workpiece fed between the lead-ins 31*a,b*. Disposed directly beneath the inner flange surfaces 33*a,b* are annular undercuts 35*a,b*. Each of the undercuts 35*a,b* includes an outer portion 37 disposed between the inner flange surface 33*a,b* of its respective flange member 26*a,b*, and the upper edge of the abrasive outer surface 11 of the wheel member 24. Each of the undercuts 35*a,b* further includes an inner portion 39 disposed between the outer abrasive surface 11 of the wheel member 3, and a point below the outer surface 11. Preferably, the length of the inner portion 39 of each of the undercuts 35*a,b* is approximately twice as much as the length of the outer portion 37 for reasons to be given hereinafter.

Figure 4:
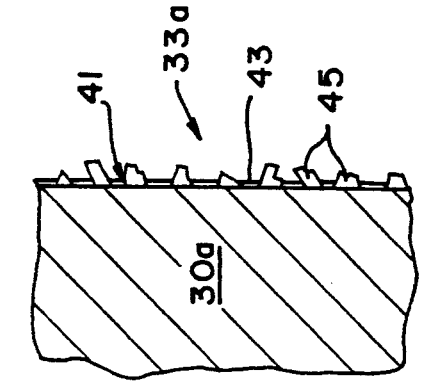
FIG. 4 is an enlargement of the area enclosed within the dotted circle in FIG. 3 indicated at 4.
Figure 5:
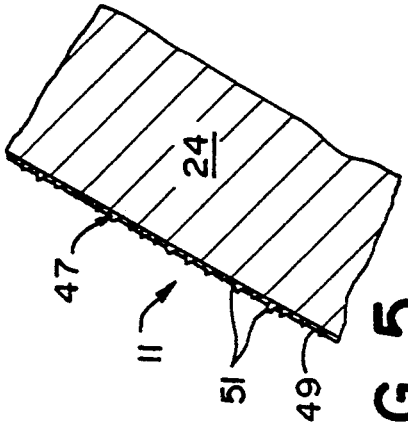
FIG. 5 is an enlargement of the area enclosed by the dotted circle in FIG. 3 indicated at 5.

FIGS. 4 and 5 illustrate the difference in the coarseness of the abrasive coating applied to the lead-ins 31*a,b* and inner flange surfaces 33*a,b* and the abrasive coating applied to the outer surface 11 of the wheel member 24. Specifically, the diamond coating 41 on these portions of the annular flange members 26*a,b* is formed from a layer of nickel plating 43 which partially encases 20 to 30 mesh diamond grit 45. By contrast, the diamond coating 47 that covers the outer surface 11 of the wheel member 24 is formed from a thinner nickel plating 49 which partially encases a much finer diamond grit of 140 to 170 mesh. The use of diamond grit particles 45 on the inner flange surfaces 33*a,b* which have a length that is approximately six times that of the diamond particles 51 used to form the abrasive coating on the outer surface 11 of the wheel member 24 advantageously reduces the friction between the belt 2 and the grinding wheel assembly 23 during the grinding operation, which in turn expedites the cutting operation and prevents burn damage to the belt 2. Such a difference in the size of the abrasive particles further reduces the amount of wear that the diamond coating 41 on the inner flange surfaces 33*a,b* experiences, which in turn tends to reduce the wear pattern experienced by the wheel assembly 23 as a whole. Such reduced wear increases the useful life span of the grinding wheel assembly 23 over prior art grinding wheel assemblies.

Figure 3:
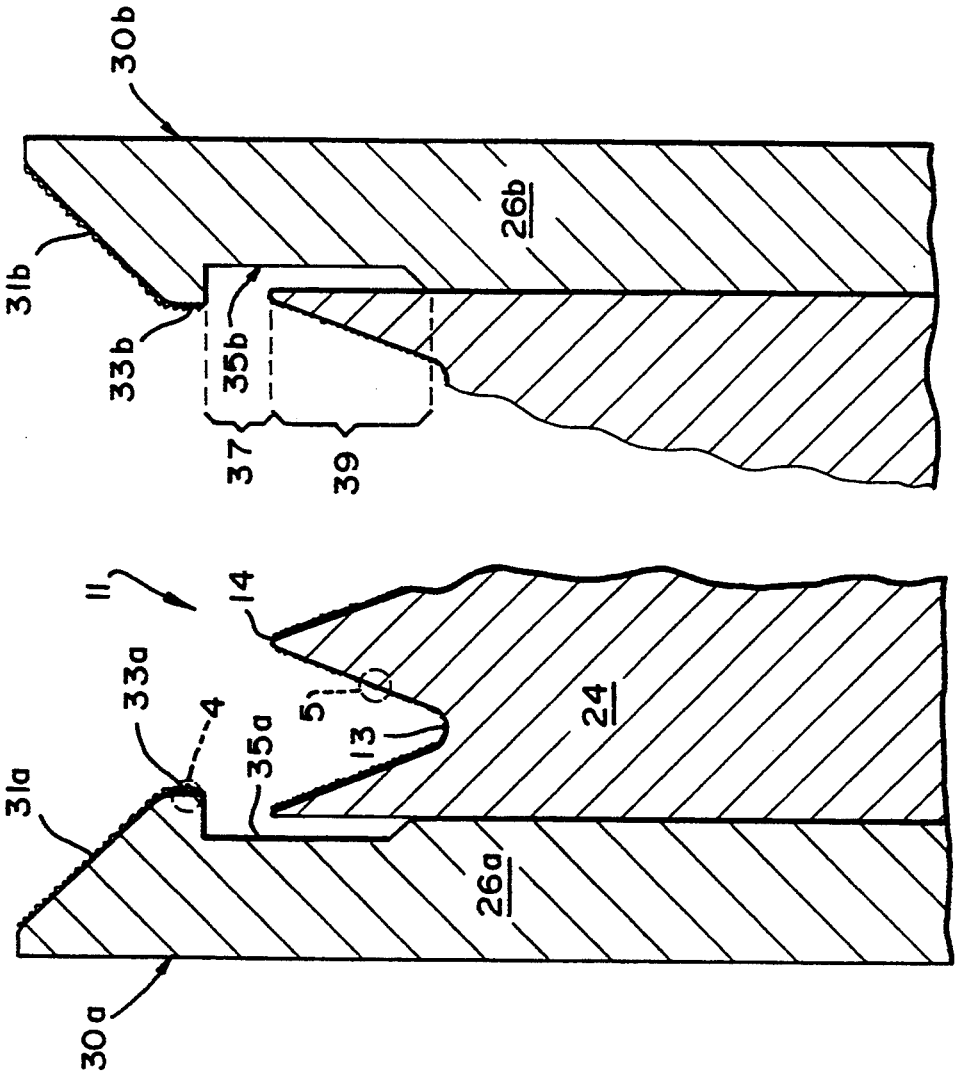
FIG. 3 is an enlargement of the upper portion of the grinding wheel assembly illustrated in FIG. 2B.

In operation, the outer portion of the undercut 37 provides an area within the grinding wheel assembly 23 where the swarf or grindings 22 can collect without applying a binding pressure between the inner flange surfaces 33*a,b* and the side portions 20*a,b* of the belt 2. The inner portion of the undercut 39 provides an area where the rapid rotation of the wheel member 24 can create turbulent air currents, which in turn advantageously expels the grindings 22 that are led into the outer portion 37 of the undercuts 35*a,b*. The ability of the grinding wheel assembly 23 to accept shims between the inner side surfaces 29*a,b* of the flange members 26*a,b* and the outer annular recesses 25*a,b*, coupled with the relatively longer length of the inner portion 39 of the undercuts 35*a,b* to their outer portions 37, allows the grinding wheel 23 to be refurbished numerous times before the entire wheel assembly 23 must be entirely replaced. Specifically, as is shown in FIG. 3, the inner flange surfaces 33 are deliberately designed to laterally extend slightly beyond the sides of the outer surface 11 of the wheel member 24 when the assembly 23 is first manufactured. If this slight over-extension results in the side portions 20*a,b* of the belt 2 being cut too narrow, annular shims can be placed between the annular flanges members 26*a,b* and the recesses 25*a,b*. Over time, friction will cause the inner flange surfaces 33*a,b* to be worn down, whereupon the aforementioned shims can be removed. Similarly, over time, the outer surface 11 of the wheel member 24 will be worn down, which in turn will result in a diminishing outer diameter for the wheel member 24. However, despite a substantial wearing down of the surface 11, the relatively large length of the inner portion 39 of the undercuts 35*a,b* will always provide sufficient space for the collection and expulsion of grinding particles 22 over the life of the assembly 23.

During a refurbishing operation, the annular flange members 26*a,b* are removed from the wheel member 24 by unscrewing the mounting screws 27. Then the old diamond coatings 41 and 47 which cover the tapered lead-ins and inner flange surfaces of the annular flange members 26*a,b* and the outer surface 11 of the wheel member 24 are removed, which causes some diminishment in the lateral distance between the inner flange surfaces 33*a,b* when they are remounted on the wheel member 24, as well as some diminishment in the outer diameter of the wheel member 24. Next, new diamond coatings 41 and 47 of different coarsenesses are applied to the annular flange members 26 and the wheel member 24. This step of the refurbishing operation is greatly facilitated by the removability of the annular flange members 26*a,b* from the wheel member 3. Finally, the annular flange members 26*a,b* are remounted into their respective recesses 25*a,b* by means of the aforementioned mounting screws 27.

While the invention has been described in the context of a preferred embodiment, numerous modifications and variations of the invention will become evident to persons of ordinary skill in the art. All such modifications and variations are intended to be encompassed within the scope of this invention, which is limited only by the claims appended hereto.

We claim:

1. A grinding wheel assembly for grinding and sizing a workpiece, comprising:

a wheel member including an abrasive, annular outer surface, and a pair of opposing annular flanges attached to the wheel member and disposed around and radially extending beyond said abrasive outer surface, wherein each of said flanges includes an inner abrasive surface for sizing a workpiece that is substantially coarser than the abrasive outer surface of the wheel member for reducing friction associated with said sizing.

2. The grinding wheel assembly of claim 1, wherein said annular outer surface of said wheel member is coated with abrasive particles of a first mesh size, and said inner surfaces of said flanges are coated with abrasive particles of a second mesh size that is at least double that of said first mesh size.

3. The grinding wheel assembly of claim 1, wherein said annular outer surface of said wheel member is coated with abrasive particles of a first mesh size, and said inner surfaces of said flanges are coated with abrasive particles of a second mesh size that is at least three times that of said first mesh size.

4. The grinding wheel assembly of claim 1 wherein said annular outer surface of said wheel member is coated with abrasive particles of a first mesh size, and said inner surfaces of said flanges are coated with abrasive particles of a second mesh size that is at least six times that of said first mesh size.

5. The grinding wheel assembly of claim 1, wherein each of said flanges includes an undercut portion located radially inward from said inner abrasive surface and adjacent to said abrasive annular outer surface of said wheel member wherein said undercut portion receives grindings and generates air turbulence for expelling said grindings from said wheel assembly.

6. The grinding wheel assembly of claim 1, wherein said flanges are the outer periphery of a pair of flange members that are detachably connectable around opposing sides of said wheel member.

7. The grinding wheel assembly of claim 5, wherein said flanges are the outer periphery of a pair of flange members that are detachably connectable around opposing sides of said wheel member, and wherein said undercut portion extends radially inwardly from said inner abrasive surface to maximum radially outer dimension of said abrasive annular outer surface of said wheel member.

8. A grinding wheel assembly for grinding and sizing a workpiece, comprising:

a wheel member including an abrasive, annular outer surface;

a pair of annular flange members detachably connectable to opposing sides of said wheel member for providing opposing annular flanges that circumscribe and radially extend beyond opposing sides of the abrasive annular outer surface of the wheel member, wherein each of the flanges includes an inner abrasive surface for sizing a workpiece and the inner abrasive surface of each of the flanges is coarser than the abrasive annular outer surface of the wheel member.

9. The grinding wheel assembly of claim 8, wherein the inner surface of each of said flanges includes an undercut portion located radially inwardly from said inner abrasive surface and adjacent to said abrasive annular outer surface of said wheel member, wherein said undercut portion both receives grindings and generates air turbulence for expelling said grindings from said wheel assembly.

10. The grinding wheel assembly of claim 9, wherein the undercut portion extends radially inwardly from said annular inner abrasive surface to a maximum radially outer dimension of said abrasive annular outer surface of said wheel member to accommodate variations in the outer diameter of said wheel member caused by tolerances, wear, and refinishing.

11. The grinding wheel assembly of claim 8, wherein said annular outer surface of said wheel member is coated with abrasive particles of a first mesh size, and said inner surfaces of said flanges are coated with abrasive particles of a second mesh size that is at least double that of said first mesh size.

12. A grinding wheel assembly for grinding and sizing a workpiece, comprising:

a wheel member including an abrasive, annular outer surface;

a pair of opposing annular flanges attached to the wheel member and disposed around and radially extending beyond said abrasive outer surface, wherein each of said flanges includes an inner abrasive surface for sizing a workpiece, and an undercut portion located radially inwardly from said inner abrasive surface and adjacent to said abrasive annular outer surface of said wheel member for both receiving grindings and for generating air turbulence to facilitate the expulsion of said grindings from said wheel assembly.

13. The grinding wheel assembly of claim 12, wherein the inner abrasive surface of each of the flanges is coarser than the abrasive annular outer surface of the wheel member.

14. The grinding wheel assembly of claim 13, wherein said annular outer surface of said wheel member is coated with abrasive particles of a first mesh size, and said inner surfaces of said flanges are coated with abrasive particles of a second mesh size that is at least double that of said first mesh size.

15. The grinding wheel assembly of claim 14, wherein said workpiece is an elastomeric belt, and said abrasive particles on the outer surface of the wheel member and the inner surfaces of said flanges are 140–170 mesh diamond particles and 20–30 mesh diamond particles, respectively.

16. A grinding wheel for grinding and sizing elastomeric power transmission belts, comprising:

a circular wheel member having an annular outer surface that is serrated and coated with abrasive particles;

a pair of annular flange members detachably connectable to opposing sides of said wheel member for providing opposing annular flanges that circumscribe and radially extend beyond opposing sides of the abrasive annular outer surface of the wheel member, wherein each of the flanges includes an inner abrasive surface that is coarser than the abrasive outer surface of the circular wheel member for laterally sizing an elastomeric belt, and wherein each of the flanges includes an undercut portion that radially extends from said inner abrasive surface to a point under the annular outer surface of the wheel member for both receiving grindings from said belt and for generating air turbulence for expelling said grindings from said wheel assembly.

* * * * *